US005333561A

United States Patent [19]

Katou

[11] Patent Number: 5,333,561

[45] Date of Patent: Aug. 2, 1994

[54] APPARATUS FOR SHIFTING SEWING POSITION IN A SEWING MACHINE

[75] Inventor: Yutaka Katou, Kariya, Japan

[73] Assignee: Aisin Seiki Kabushiki Kaisha, Kariya, Japan

[21] Appl. No.: 91,130

[22] Filed: Jul. 14, 1993

[30] Foreign Application Priority Data

Jul. 14, 1992 [JP] Japan ..... 4-186795

[51] Int. Cl.[5] ..... D05B 21/00

[52] U.S. Cl. ..... 112/121.14

[58] Field of Search ..... 112/121.14, 121.12, 112/117, 118, 119, 103, 2, 121.15

[56] References Cited

U.S. PATENT DOCUMENTS 3,515,080 6/1970 Ramsey ..... 112/121.14
3,605,661 9/1971 Cooper ..... 112/118
4,503,788 3/1985 Giannuzzi et al. ..... 112/121.14 X
4,505,212 3/1985 Schwarzberger ..... 112/118
4,969,410 11/1990 Brower et al. ..... 112/121.14 X
5,040,473 8/1991 Zesch et al. ..... 112/117
5,103,747 4/1992 Resta et al. ..... 112/121.14 X

FOREIGN PATENT DOCUMENTS 61-32626 6/1986 Japan .
62-32544 8/1987 Japan .

*Primary Examiner*—Peter Nerbun
*Attorney, Agent, or Firm*—Sughrue, Mion, Zinn, Macpeak & Seas

[57] ABSTRACT

A main body (an arm assembly and a bed assembly) of a sewing machine is made movable in both fore-and-aft direction and in a lateral direction over an extended area as compared with the size of an overall sewing machine to extend an area over which a sewing operation is enabled while simultaneously increasing the sewing rate. An arm assembly 5 and a bed assembly 2 are completely separate from each other mechanically, and are each supported by an independent shifting mechanism 10, 20 for movement through a same travel in directions of X- and Y-axes to shift a sewing position.

7 Claims, 6 Drawing Sheets

APPARATUS FOR SHIFTING SEWING POSITION IN A SEWING MACHINE

BACKGROUND OF THE INVENTION

The invention relates to an apparatus for shifting a sewing position in a sewing machine which may be utilized in an automatic figured cloth sewing machine, for example.

In a sewing machine, a sewing position is shifted by the movement of either one of the body of the sewing machine or a fabric being sewn. For example, in an embroidery machine, a frame which is freely movable in either X- or Y-axis direction is used to support a fabric, and may be moved to enable a shifting of the sewing position in diverse directions.

A sewing machine in which a fabric is fixed while the body of the sewing machine is moved is disclosed, for example, in Japanese Utility Model Publication No. 32,626/1986. In a conventional sewing machine of this kind, support members such as rails are used to support a carriage in a manner so as to be freely movable in fore-and-aft direction under the control of a first drive mechanism, while the main body of the sewing machine is movably supported on the carriage by separate support members such as rails, with the main body being associated with another drive mechanism which drives it in a lateral direction.

The main body of the sewing machine generally comprises an arm assembly including a needle, a needle bar, an upper shaft and the like, and a bed assembly including a shuttle race, a shuttle bobbin, a lower shaft and the like. The arm and the bed assembly must be exactly matched in position. Since a fabric to be sewn is disposed between the arm and the bed assembly, the both assemblies are connected together by a stanchion, which is disposed laterally offset, so as to be integrally coupled together in a usual sewing machine. However, the stanchion stands in the way to the movement of the fabric. Accordingly, it is a usual practice to employ a design to assure a possible maximum distance between the needle position and the location of the stanchion in order to increase an area over which a sewing operation is enabled.

In the sewing machine disclosed in Japanese Utility Model Publication No. 32,626/1986, the arm and the bed assembly are separate from each other, and a mismatch in the position of the both assemblies is avoided by driving the both assemblies through a same stroke on the carriage. Frames disposed on the opposite sides of the carriage, namely, at its right and left ends thereof are used to support the arm and the bed assembly. By increasing the spacing between the left and the right end of the carriage, an arrangement is made to allow a relatively large area of movement of the arm and the bed assembly in the lateral direction.

However, in the conventional sewing machine described, since the arm and the bed assembly are mounted on the same carriage, the area of movement of the main body of the sewing machine in the lateral direction is limited by the presence of the frames located at the opposite ends of the carriage so as to be restricted to a zone inside the both frames. In actuality, because the frames located at the opposite ends of the carriage as well as the main body of the sewing machine have definite sizes, the area through which the main body of the machine can move in the lateral direction is considerably limited as compared to the dimension of the entire carriage.

If the carriage is made to a larger size in order to achieve a greater area of movement of the main body of the sewing machine in the lateral direction, the increased weight of the carriage prevents the speed of movement thereof from being increased, presenting a problem in respect of the sewing rate.

SUMMARY OF THE INVENTION

Accordingly, it is an object of the invention to enable a movement of a main body (an arm assembly and a bed assembly) of a sewing machine in both fore-and-aft direction and in a lateral direction through a greater area than achieved in the prior art to thereby extend the area over which a sewing operation is possible while enabling an improvement in the sewing rate.

The above object is accomplished by an apparatus for shifting a sewing position in a sewing machine constructed according to the invention, comprising lower shifting means (10) mounted on a base (1) and including movable supports (11*x*, 11*y*) which are movable in directions corresponding to a pair of axes in a horizontal plane; machine bed means (2) supported by the movable support of the lower shifting means and including a shuttle race, a shuttle bobbin, a lower shaft and the like; overhead support means (4) supported on top of the base by means of four stanchions (3*a*, 3*b*, 3*c*, 3*d*) which are disposed at the four corners of a rectangle; upper shifting means (20) supported by the overhead support means and including movable supports (21*x*, 21*y*) which are movable in directions corresponding to a pair of axes in a horizontal plane; machine arm means (5) supported by the movable support of the upper shifting means and including a needle, a needle bar, an upper shaft and the like; fabric support means (7) for supporting a fabric (6) disposed between the machine bed means and the machine arm means; and alignment control means (8) for controlling the travel of each of the lower and the upper shifting means to align the machine bed means and the machine arm means relative to each other.

Numerals and characters appearing in the parentheses designate the reference numerals and characters used to designate elements used in an embodiment to be described later, but it should be understood that the elements used to practice the invention are not limited to the particular elements shown in the embodiments.

DETAILED DESCRIPTION OF PREFERRED EMBODIMENTS

Figure 1:
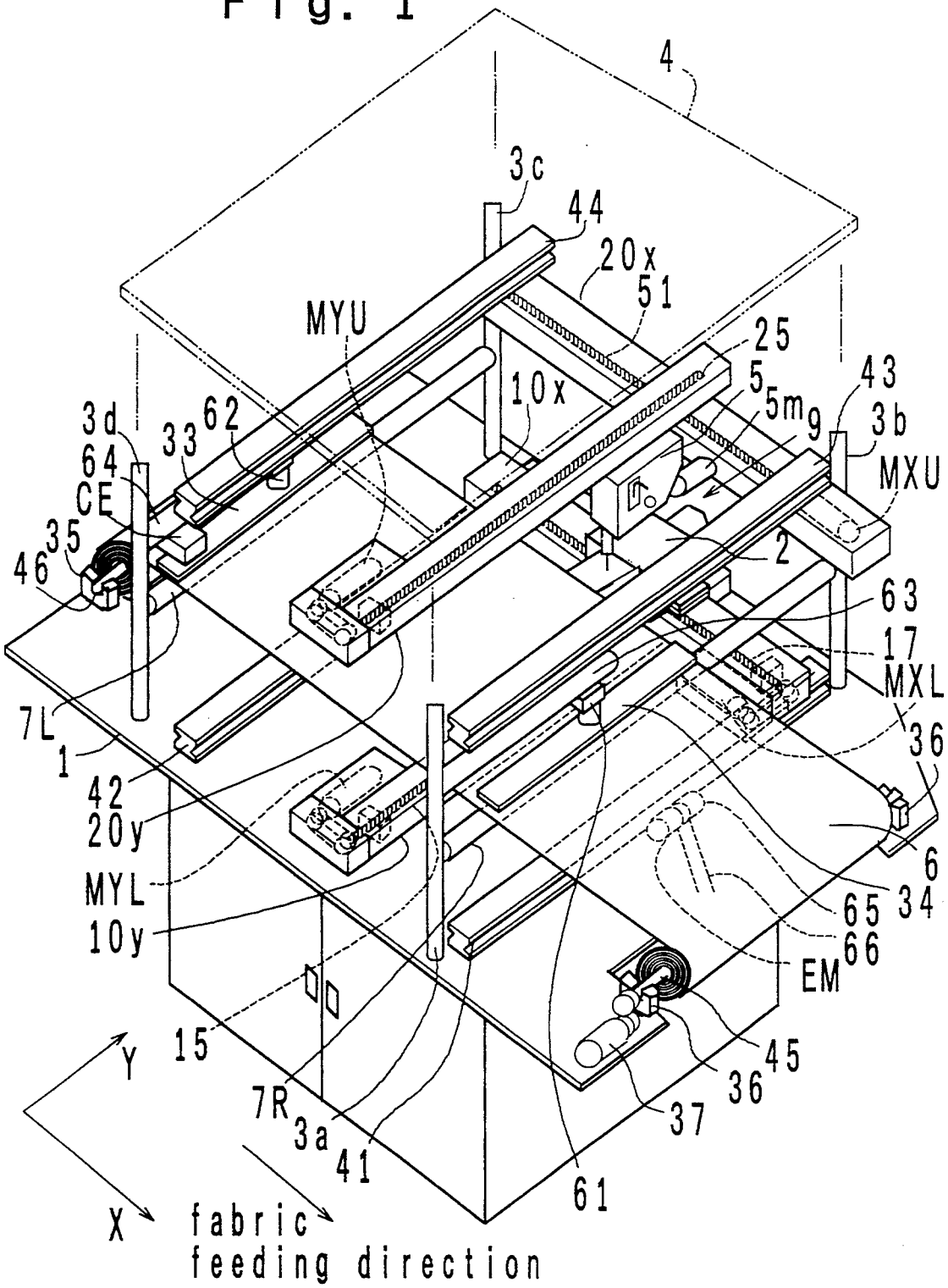
FIG. 1 is a perspective view showing the appearance of a sewing machine of an embodiment.

The appearance of a sewing machine according to an embodiment is shown in FIG. 1 where an overhead board 4 is removed. Referring to FIG. 1, a sewing machine includes a main body 9 comprising a bed assembly (a mechanism associated with a lower shaft) 2 disposed below a fabric 6 and an arm assembly (a mechanism associated with an upper shaft) 5 disposed above the fabric 6, the both assemblies being completely separate from each other mechanically. Thus, in the sewing machine illustrated, a sewing position is shifted by a movement of the main body 9 relative to the fabric 6, but the bed assembly 2 and the arm assembly 5 are shifted in each direction corresponding to X- and Y-axis by independent shifting mechanisms 10 and 20 which are completely separate from each other mechanically.

The bed assembly 2 is connected to a movable portion of the X-axis shifting mechanism 10*x* and is supported to be movable in the direction of the X-axis. The X-axis shifting mechanism 10*x* has its opposite ends engaged with guide rails 41, 42 so as to be slidable in the direction of the Y-axis along the rails. The Y-axis shifting mechanism 10*y* includes a movable portion which is connected to the X-axis shifting mechanism 10*x*. The movable portion of the Y-axis shifting mechanism 10*y* is driven by an electric motor MYL while the movable portion of the X-axis shifting mechanism 10*x* is driven by an electric motor MXL. Accordingly, when the motor MXL is driven, the bed assembly 2 is shifted in the direction of the X-axis while it is shifted in the direction of the Y-axis when the motor MYL is driven. The guide rails 41, 42 and the Y-axis shifting mechanism 10*y* are fixedly mounted on a table 1.

The overhead board 4 is supported on top of the table 1 by stanchions 3*a*, 3*b*, 3*c* and 3*d* disposed at the four corners of a rectangle and is disposed to be horizontal. Guide rails 43, 44 and a Y-axis shifting mechanism 20*y* are fixedly connected to the overhead board 4. The guide rails 43, 44 slidably carry an X-axis shifting mechanism 20*x*, which has its opposite ends engaged with these rails. The Y-axis shifting mechanism 20*y* includes a movable portion which is connected to the X-axis shifting mechanism 20*x*. The X-axis shifting mechanism 20*x* also includes a movable portion, which supports the arm assembly 5. The movable portion of the Y-axis shifting mechanism 20*y* is driven by an electric motor MYU while the movable portion of the X-axis shifting mechanism 20*x* is driven by an electric motor MXU. Accordingly, the arm assembly 5 is shifted in the direction of the X-axis when the motor MXU is driven, and is shifted in the direction Y-axis when the motor MYU is driven.

Figure 2:
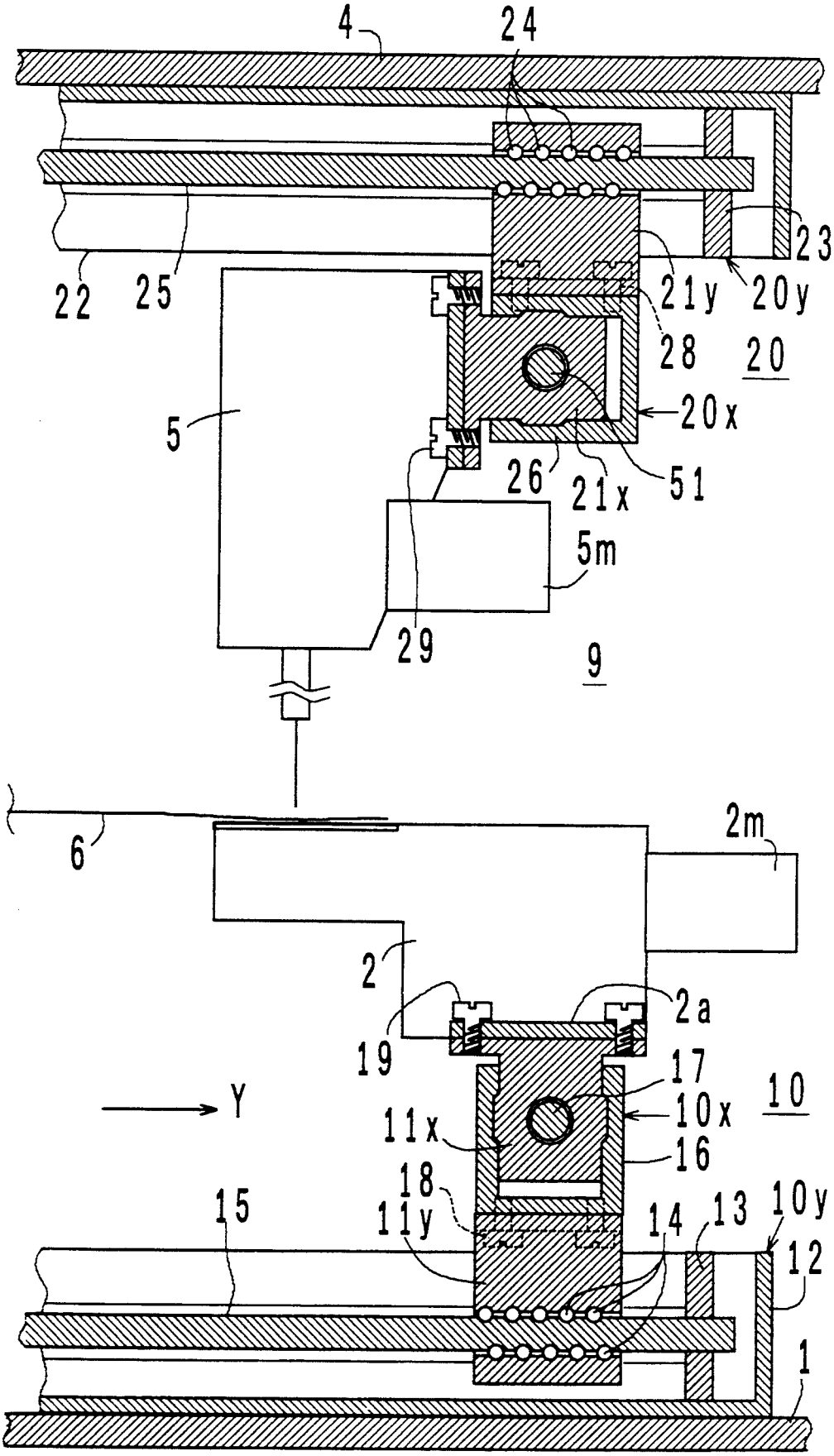
FIG. 2 is a fragmentary cross section of a support structure for a bed assembly and an arm assembly of the sewing machine shown in FIG. 1.

A support structure for the bed assembly 2 and the arm assembly 5 is shown in FIG. 2. Referring to FIG. 2, the Y-axis shifting mechanism 10*y* includes a frame 12 which is disposed to extend along the direction of the Y-axis and is formed to be open upward, thus presenting a substantially U-shaped cross section. A threaded rod 15 is rotatably supported by a bearing 13 within the frame 12. The threaded rod 15 engages a nut 11*y* through balls. Thus, the combination of the threaded rod 15, the balls 14 and the nut 11*y* defines a ball screw, driving the nut 11*y* in the direction of the Y-axis when the threaded rod 15 is driven for rotation. As shown in FIG. 1, one end of the threaded rod 15 is connected to the motor MYL. The X-axis shifting mechanism 10*x* is fixedly mounted on top of the nut 11*y* by means of set screws 18.

The X-axis shifting mechanism 10*x* comprises a frame 16 which is substantially U-shaped in section, a threaded rod 17, balls (not shown) and a nut 11*x*, in the similar manner as the Y-axis shifting mechanism 10*y*. When the threaded rod 17 is driven for rotation, the nut 11*x* is driven in the direction of the X-axis. As shown in FIG. 1, one end of the threaded rod 17 is connected to the motor MXL. The nut 11*x* and the bed assembly 2 which is disposed on top thereof are secured together in the region of a flange 2*a* by set screws 19. The bed assembly 2 includes a machine motor 2*m* which drives a lower shaft disposed within the assembly.

The Y-axis shifting mechanism 20*y* includes a frame 22, which is disposed to extend in the direction of the Y-axis, and is open downward, thus presenting an inversed U-shaped cross section. A threaded rod 25 is rotatably supported by a bearing 23 within the frame 22, and the threaded rod 25 is engaged with a nut 21*y* through balls 24. The combination of the threaded rod 25, the balls 24 and the nut 21*y* defines a ball screw, whereby the nut 21*y* is driven in the direction of the Y-axis when the threaded rod 25 is driven for rotation. As shown in FIG. 1, one end of the threaded rod 25 is connected to the motor MYU. The X-axis shifting mechanism 20*x* is secured to the underside of the nut 21*y* by set screws 28.

The X-axis shifting mechanism 20*x* includes a frame 26 which is substantially U-shaped in section, a threaded rod 51, balls (not shown) and a nut 21*x*, in the similar manner as the Y-axis shifting mechanism 20*y*. The nut 21*x* is driven in the direction of the X-axis when the threaded rod 51 is driven for rotation. As shown in FIG. 1, one end of the threaded rod 51 is connected to the motor MXU. The arm assembly 5 is secured to the nut 21*x* by set screws 29. The arm assembly 5 includes a machine motor 5*m* which drives an upper shaft disposed within the assembly.

Figure 3:
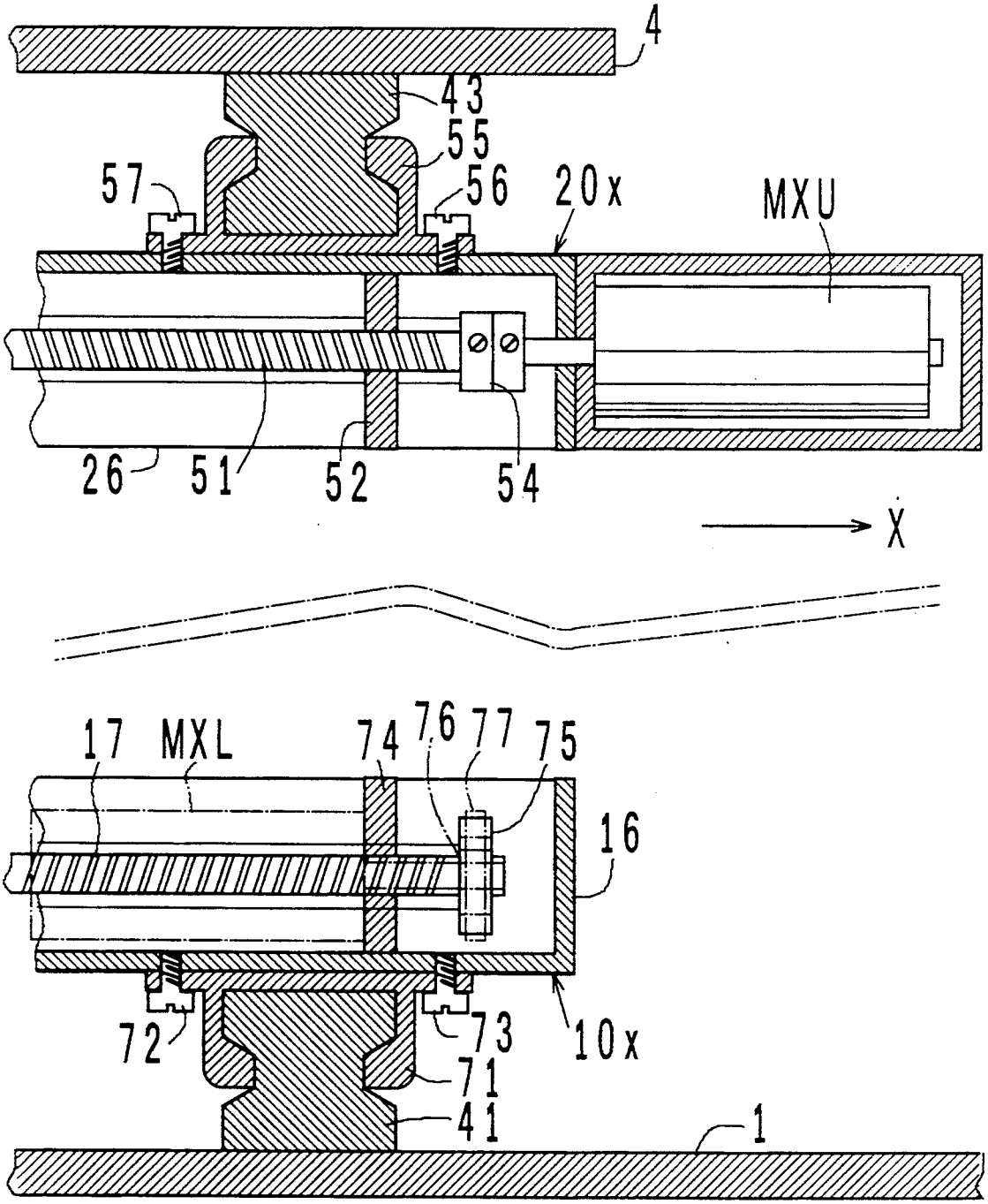
FIG. 3 is a cross section of one end of X-axis shifting mechanism 10*x*, 20*x*.

A support structure for a portion of the X-axis shifting mechanisms 10*x* and 20*x* is shown in FIG. 3. Referring to FIG. 3, a holder 71 is secured toward one end of the frame 16 of the X-axis shifting mechanism 10*x*, by means of set screws 72, 73. The holder 71 engages the guide rail 41 which is fixedly mounted on the table 1, and thus is supported so as to be movable in the direction of the Y-axis along the guide rail 41. The threaded rod 17 is rotatably supported by the frame 16 through a bearing 74. A pulley 75 mounted on one end of the threaded rod 17 and another pulley 76 mounted on the drive shaft of the motor MXL are coupled together by a belt 77. The other end of the frame 16 of the X-axis shifting mechanism 10*x* is supported by a similar mechanism.

A holder 55 is secured toward one end of the frame 26 of the X-axis shifting mechanism 20*x* by means of set screws 56, 57, and engages a guide rail 43 secured to the bottom surface of the overhead board 4, and thus is movable in the direction of the Y-axis along the guide rail 43. The threaded rod 51 is rotatably supported by the frame 26 through a bearing 52. One end of the threaded rod 51 and the drive shaft of the motor MXU are coupled together by a coupling 54. The other end of the frame 26 of the X-axis shifting mechanism 20*x* is supported by a similar mechanism.

Returning to FIG. 1, the fabric 6 which is used in this sewing machine has an increased length, and has its opposite ends disposed as rolls which are wound around core rods 45, 46. One of the core rods, 45, is placed on a pair of receivers 36 which are mounted on the table 1 toward its right end, and thus is supported in a rotatable manner. Similarly, the other core rod 46 is disposed on a pair of receivers 35 mounted on the table 1 at the left end thereof, and thus is supported in a rotatable manner. One end of the core rod 45 is connected to the drive shaft of an electric motor 37 through a gearing. Accordingly, when the motor 37 is driven, the core rod 45 may be rotated to take up the fabric 6 so as to shift a region of the fabric 6 which is placed within an area subject to a sewing operation by the main body 9 of the sewing machine.

During the sewing operation, it is necessary to hold the fabric 6 against movement. At this end, a clamp mechanism which holds the fabric 6 down is disposed at the right and the left end of the area which is subject to a sewing operation. Specifically, a rubber roller 7R disposed below the fabric 6 includes a shaft, the opposite ends of which are supported by right-hand stanchions 3*a* and 3*b* so as to be rotatable. A clamp plate 34 is disposed above the fabric 6 so as to be located opposite to the rubber roller 7R, and is elevatable by being supported by the stanchion 3*a* through an air cylinder 61 and a stay 63 interposed therebetween. When the clamp plate 34 is caused to move down, the fabric 6 is held sandwiched between the rubber roller 7R and the clamp plate 34, whereby it is secured in position. When the clamp plate 34 is raised, the fabric 6 may be released from such constraint.

Similarly, another rubber roller 7L disposed below the fabric 6 toward the left end of the table 1 includes a shaft, the opposite ends of which are supported by the left-hand stanchions 3*c* and 3*d* so as to be rotatable. A clamp plate 33 is disposed above the fabric 6 so as to be located opposite to the rubber roller 7L, and is elevatable by being supported by the stanchion 3*d* through an air cylinder 62 and a stay 64 interposed therebetween. When the clamp plate 33 is caused to move down, the fabric 6 is held sandwiched between the rubber roller 7L and the clamp plate 33, whereby it is secured in position. When the clamp plate 33 is raised, the fabric 6 may be released from such constraint. The clamp plate 33 fixedly carries an optical sensor CE which detects whether or not the end of the fabric 6 is reached.

Figure 4:
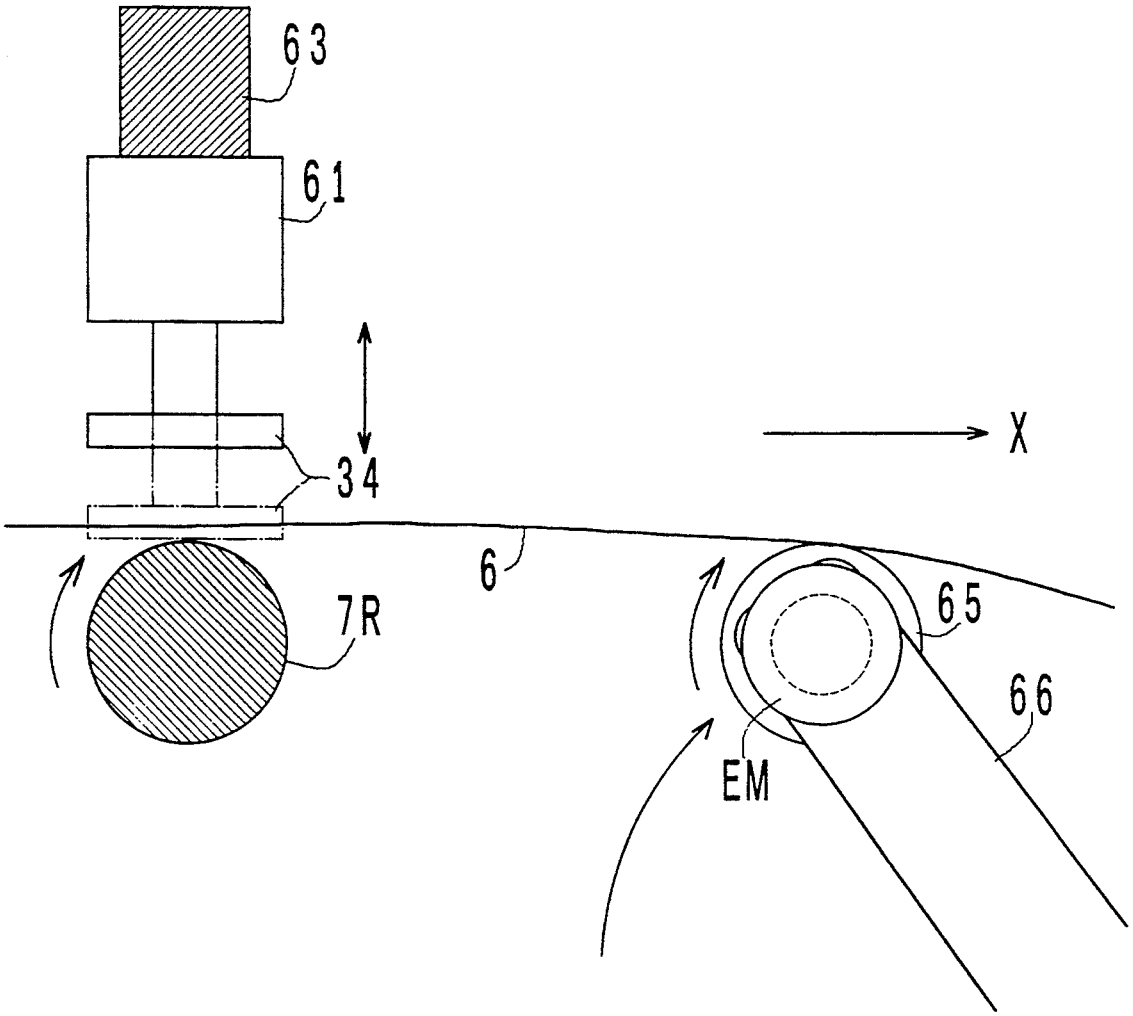
FIG. 4 is a fragmentary section of a portion located around a rotary encoder EM.

A roller 65 is rotatably carried by the free end of an arm 66 and is disposed between the rubber roller 7R and the core rod 45. The arm 66 is supported by the table 1, and is urged by a spring, not shown, so as to cause the roller 65 to be pressed against the fabric 6. A rotary encoder EM is mounted on the shaft of the roller 65. Accordingly, the rotary encoder EM produces a pulse signal in accordance with the travel of the fabric 6. An arrangement around the rotary encoder EM is illustrated in FIG. 4, to which reference is made.

Figure 5:
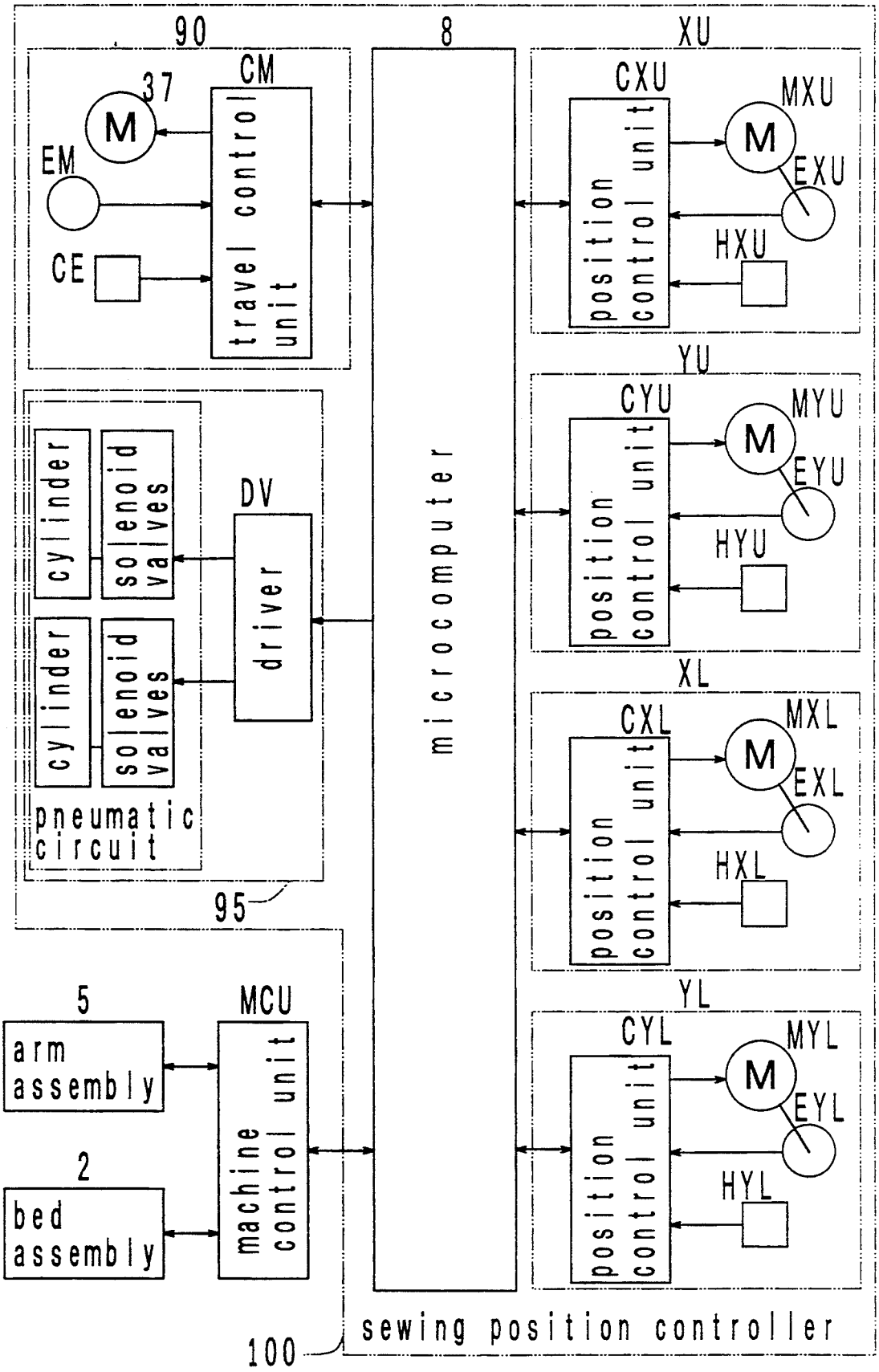
FIG. 5 is a block diagram of the electrical circuit of the sewing machine shown in FIG. 1.

The arrangement of the electrical circuit for the entire sewing machine of the embodiment is shown in FIG. 5. In this embodiment, a machine control unit MCU controls the entire sewing machine, namely, the bed assembly 2, the arm assembly 5 and the sewing position controller 100. The bed assembly 2 and the arm assembly 5, which define the main body of the sewing machine, operate in the similar manner as a usual sewing machine. However, in the present embodiment, since the bed assembly 2 and the arm assembly 5 are completely independent from each other mechanically, the rotation of the lower shaft of the bed assembly 2 and the rotation of the upper shaft of the arm assembly 5 must be synchronized by controlling the driving speed of the respective motors associated with the respective assemblies to a given ratio. It is to be noted that the motors associated with the bed assembly 2 and the arm assembly 5, respectively, are associated with rotary encoders, not shown.

The sewing position controller 100 includes an upper X-axis shifting unit XU, an upper Y-axis shifting unit YU, a lower X-axis shifting unit XL, a lower Y-axis shifting unit YL, a fabric shifting unit 90, a clamp unit 95 and a microcomputer 8 which controls all of these units.

The upper X-axis shifting unit XU comprises an electric motor MXU, a rotary encoder EXU connected to the shaft of the motor, a home position sensor HXU detecting whether or not the nut 21*x* is at its home position, and their controlling position control unit CXU. The upper Y-axis shifting unit YU comprises an electric motor MYU, a rotary encoder EYU connected to the shaft of this motor, a home position sensor HYU detecting whether or not the nut 21*y* is at its home position, and their controlling position control unit CYU. The lower X-axis shifting unit XL comprises an electric motor MXL, a rotary encoder EXL connected to the shaft of this motor, a home position sensor HXL detecting whether or not the nut 11*x* is at its home position, and their controlling position control unit CXL. The lower Y-axis shifting unit YL comprises an electric motor MYL, a rotary encoder EYL connected to the shaft of this motor, a home position sensor HYL detecting whether or not the nut 11*y* is at its home position, and their controlling position control unit CYL.

The fabric shifting unit 90 comprises an electric motor 37, the rotary encoder EM which detects the travel of the fabric 6, the end sensor CE which detects the end of the fabric 6, and a travel control unit CM which controls the motor 37. The clamp unit 95 includes a driver DV and a pneumatic circuit connected thereto. The pneumatic circuit includes air cylinders 61, 62 which are connected with solenoid valves, which in turn control these air cylinders to their expanded or retracted position. It is to be understood that air compressors are omitted from illustration in FIG. 5.

Figure 6:
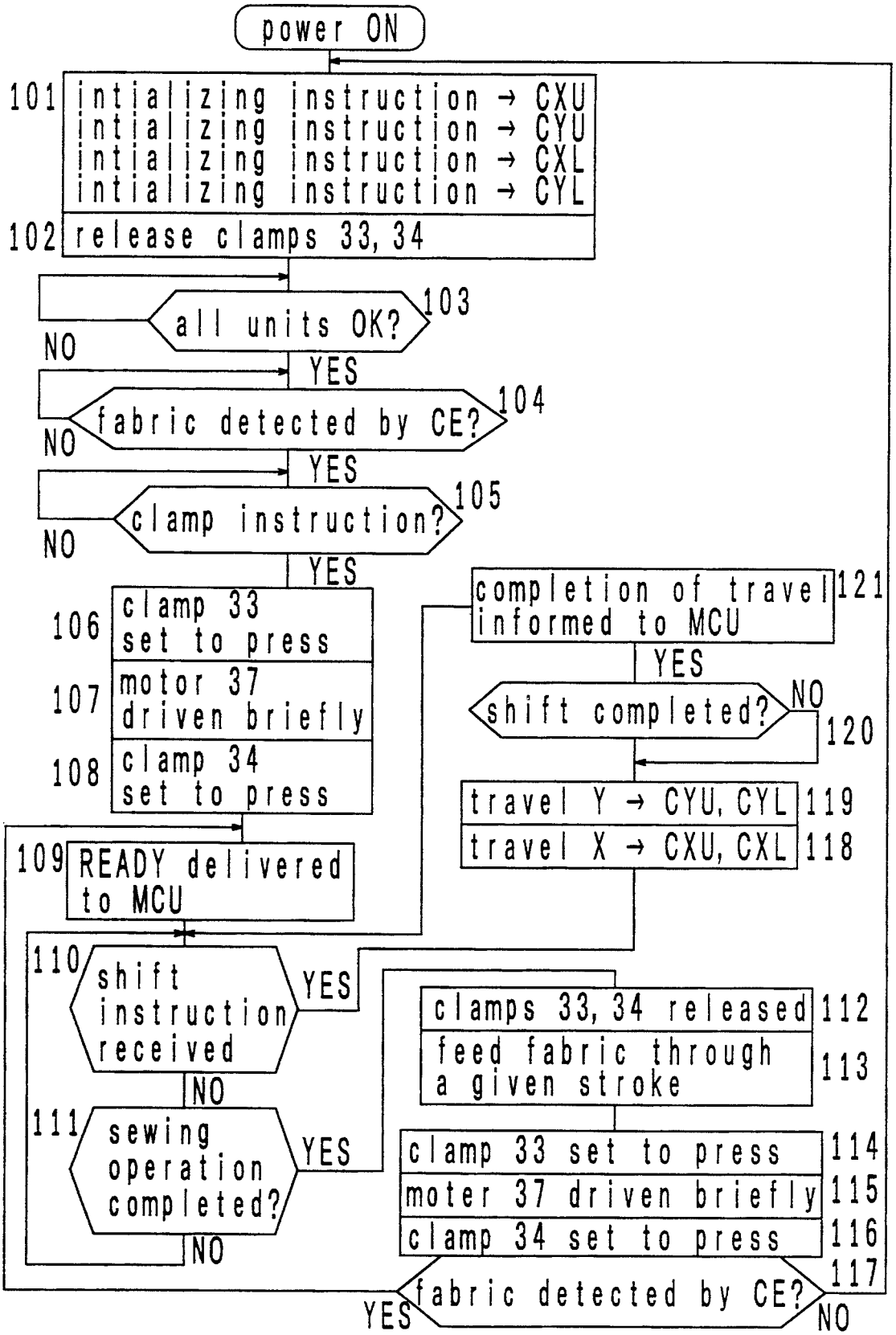
FIG. 6 is a flow chart illustrating the operation of a microcomputer 8 shown in FIG. 5.

The processing operation by the microcomputer 8 is shown in detail in FIG. 6. The operation of the microcomputer 8 will now be described with reference to FIG. 6. When the power supply is turned on, an initialization takes place. Thus, at step 101, initializing instructions are delivered to position control units CXU, CYU, CXL and CYL, whereby all of these control units have their movable portions reset to their home positions. For example, the position control unit CXU drives the motor MXU in the reverse direction, and deenergizes the motor MXU when the home position sensor HXU detects the nut 21*x*. In this manner, the bed assembly 2 and the arm assembly 5 are positioned at the given home positions. Obviously, the positioning is achieved so that the location of the shuttle race of the bed assembly 2 and the location of the needle of the arm assembly 5 coincide with each other or align in both directions of X- and Y-axis to define the sewing position. At next step 102, a signal is delivered to the driver DV to control the cylinders 61, 62, thereby raising the clamp plates 33, 34 to release the fabric 6 from constraint.

When the positioning of all the position control units CXU, CYU, CXL and CYL is completed, the program proceeds from step 103 to step 104, and if the end sensor CE has detected the presence of the fabric 6, the program then proceeds to step 105.

When a start key on the operating board, not shown, is depressed, the machine control unit MCU delivers a clamp instruction to the microcomputer 8. Upon receipt of the clamp instruction, the microcomputer 8 then proceeds to step 106.

At step 106, an energizing signal is delivered to the driver DV to control the cylinder 62 so as to lower the clamp plate 33, thus clamping the rear end of the fabric 6. At next step 107, the motor 37 is energized for rotation in the forward direction for a brief interval (which may be one second, for example), causing the core rod 45 to take up a small length of the fabric 6, thus maintaining the fabric 6 taut. At next step 108, an energizing signal is delivered to the driver DV to control the cylinder 61, thus lowering the clamp plate 34 to clamp the front end of the fabric 6. In this manner, the fabric 6 can be held in place, removing any slack therein.

At step 109, a ready signal is delivered to the machine control unit MCU in order to indicate that the sewing position controller 100 is capable of initiating a sewing operation. In response thereto, the machine control unit MCU initiates a sewing operation. Each time there occurs a need to shift the sewing position, a shift instruction is delivered to the microcomputer 8 together with a travel therefor.

Upon receipt of the shift instruction, the microcomputer 8 proceeds from step 110 to step 118 where it delivers a travel in the direction of the X-axis to the position control units CXU and CXL, and at next step 119, it delivers a travel in the direction of the Y-axis to the position control units CYU and CYL. Accordingly, the bed assembly 2 and the arm assembly 5 are shifted by the same travel in the directions of the X- and Y-axis. When all of the position control units deliver a signal indicative of the completion of the shifting operation, the program proceeds from step 120 to step 121 where a signal indicative of the completion of the shifting operation is delivered to the machine control unit MCU.

When one cycle of the sewing operation, namely, the sewing operation over an area (defined inside a rectangle formed by the stanchions *3a* to *3d*) on the fabric 6, is completed, the machine control unit MCU delivers a complete signal. Upon receipt of this signal, the microcomputer 8 proceeds from step 111 to step 112.

At step 112, a signal is delivered to the driver DV to control the cylinders 61 and 62, thus raising the clamp plates 33 and 34 to release the fabric 6 from constraint. At next step 113, the motor 37 is driven for rotation in the forward direction to feed the fabric 6 through a given stroke (which may correspond to a distance between the stanchions *3a–3d*, for example) in the direction of the X-axis until the rotary encoder EM delivers a given number of pulses.

At step 114, an energizing signal is delivered to the driver DV to control the cylinder 62, thus lowering the clamp plate 33 to clamp the rear end of the fabric 6.

At next step 115, the motor 35 is energized for rotation in the forward direction for a brief interval (which may be one second, for example), causing the core rod 45 to take up a small length of the fabric 6, thus maintaining the fabric 6 taut. At next step 116, an energizing signal is delivered to the driver DV to control the cylinder 61, thus lowering the clamp plate 34 to clamp the fabric 6 toward its front end.

At step 117, the end sensor CE examines if it is detecting the presence of the fabric 6. If the end sensor CE is detecting the fabric 6, meaning that the terminal end of the fabric 6 is still disposed around the core rod 46 and there remains an area thereof which is to be sewn, the program returns to step 109. In this instance, when the microcomputer 8 delivers a ready signal to the machine control unit MCU at step 109, the machine control unit MCU initiates a sewing operation for the fresh area, delivering a shift instruction to the microcomputer 8 from time to time as the sewing operation proceeds. Accordingly, the microcomputer 8 repeats the described operation.

When the sewing operation is repeatedly performed, and the fabric 6 is fed to its terminal end as the core rod 45 takes up it to cause the terminal end of the fabric 6 to be disengaged from the core rod 46, the end sensor CE ceases to detect the presence of the fabric 6. Then, the program returns from step 117 to step 101. Accordingly, by executing the step 101, the bed assembly 2 and the arm assembly 5 are returned to their home positions, and by executing the step 102, the constraint by the clamp plates 33 and 34 are released, assuming a standby condition. Accordingly, the fabric 6 is replaced by a fresh one, and the start key may be depressed to repeat the described sewing operation.

In the described embodiment, there has been provided a mechanism for shifting the main body of the machine, or the bed assembly 2 and the arm assembly 5 in both directions corresponding to X- and Y-axes, but it should be understood that a mechanism for shifting the main body only in the direction of the Y-axis may be provided while the shift in the direction of the X-axis may be achieved by a movement of the fabric 6. However, it is necessary to take the thickness and the flexibility of the fabric 6 into consideration, and therefore a practical mechanism must be equipped with a fabric feeder which has a high accuracy of feed position.

A sewing machine which is used with a fabric disposed on a pair of rolls has been described in the embodiment, but for a sewing machine which utilizes a fabric cut to a given size, the mechanism which supports the fabric may be more simply constructed, utilizing a simple frame and a fixing mechanism, for example.

As described above, in accordance with the invention, the bed means and the arm means of the sewing machine are completely separate from each other and are driven by independent drive mechanisms. The bed means may be shifted in any desired direction in a horizontal plane with respect to the base by driving lower shifting means while the arm means may be shifted in any desired direction in a horizontal plane relative to the base by driving the upper shifting means. The overhead support means which supports the arm means is supported on top of the base by means of four stanchions which are disposed at four corners of a rectangle, and there is no need to provide a frame between adjacent stanchions. Accordingly, if the bed means and the arm means are shifted from one end to the other end of the movable range, they cannot be driven into collision. In this manner, the bed means and the arm means may be shifted over a relatively broad area relative to the size of the overall sewing machine, thus providing the capability of sewing over an extended area. Since the support mechanism and the drive mechanism for the bed means and the arm means are completely separate from each other mechanically, the weight driven by the respective associated drive mechanism is reduced as compared with a conventional carriage in which the bed and the arm assembly are integrally coupled together. This allows the speed of movement of each assembly, and hence the sewing rate to be increased.

What is claimed is:

1. An apparatus for shifting a sewing position in a sewing machine comprising:

lower shifting means mounted on a base and having a movable support which is disposed for movement along a pair of axial directions in a horizontal plane;

machine bed means supported by movable support of the lower shifting means and including at least a shuttle race, a shuttle bobbin and a lower shaft;

overhead support means mounted on top of the base by means of four stanchions disposed at four corners of a rectangle;

upper shifting means supported by the overhead support means and having a movably support which is disposed for movement in a pair of axial directions in a horizontal plane;

machine arm means supported by the movable support of the upper shift means and including at least a needle, a needle bar and an upper shaft;

means for supporting an object to be sewn which is disposed between the machine bed means and the machine arm means; and alignment control means for controlling the travel of the lower and the upper shifting means for aligning the machine bed means and the machine arm means with respect to each other;

wherein said lower shifting means includes at least shifting means for shifting said machine bed means in one axial direction and being arranged to move with said machine bed means as a single unit when said machine bed means is moved along another axial direction; and wherein said upper shifting means includes at least a shifting means for moving said machine arm means in one axial direction and being arranged so as to move with said machine arm means as a single unit when said machine arm means is moved in another axial direction.

2. An apparatus for shifting a sewing position in a sewing machine comprising:

lower shifting means mounted on a base and having a movable support which is disposed for movement along a pair of axial directions in a horizontal plane;

machine bed means supported by the movable support of the lower shifting means and including at least a shuttle race, a shuttle bobbin and a lower shaft;

overhead support means mounted on top of the base by means of four stanchions disposed at four corners of a rectangle;

upper shifting means supported by the overhead support means and having a movable support which is disposed for movement in a pair of axial directions in a horizontal plane;

machine arm means supported by the movable support of the upper shift means and including at least a needle, a needle bar and an upper shaft;

means for supporting an object to be sewn which is disposed between the machine bed means and the machine arm means; and alignment control means for controlling the travel of the lower and the upper shifting means for aligning the machine bed means and the machine arm means with respect to each other;

said lower shifting means comprising a first shifting means and a second shifting means, said first shifting means including a first movable support which is movable along a first axial direction and said second shifting means including a second movable support which is movable along a second axial direction, said second shifting means is connected with said first movable support and said second movable support is connected with said machine bed means, said second shifting means is supported to be movable in said first axial direction; and said upper shifting means comprising a third shifting means and a fourth shifting means, said third shifting means including a third movable support which is movable along a third axial direction and said fourth shifting means including a fourth movable support which is movable along a fourth axial direction, said fourth shifting means is connected with said third movable support, said fourth movable support is connected with said machine arm means, said fourth shifting means is supported to be movable in said third axial direction.

3. An apparatus according to claim 2, wherein said machine bed means is disposed above said first shifting means and said machine arm means is disposed below said third shifting means.

4. An apparatus according to claim 3, wherein at least one of the lower and upper shifting means comprises ball screw means including a threaded rod which is rotatably supported and having drive means connected to one end thereof, a nut having an opening through which the threaded rod extends and balls disposed between the threaded rod and the nut for engagement therewith.

5. An apparatus according to claim 4, wherein the alignment control means includes home position detecting means which detects whether or not the nut is at its given home position, the lower and upper shifting means being moved to their respective home positions as reference to the condition detected by the home position detecting means in order to align the machine bed means and the machine arm means.

6. An apparatus according to claim 4, wherein the alignment control means includes rotation detecting means coupled to the drive shaft of the drive means, the travel of each of the machine bed means and the machine arm means being detected on the basis of a signal delivered by the rotation detecting means.

7. An apparatus according to claim 3, wherein said means for supporting an object to be sewn includes a plurality of rotary shafts which rotatably support an object to be sewn which is in the form of a roll at a delivery side and a take-up side and clamp means for securing the object to be sewn at locations outside the sewing area.

* * * * *